United States Patent [19]

Müller

[11] 4,086,607

[45] Apr. 25, 1978

[54] X-RAY FILM PROCESSOR

[75] Inventor: Mathias Müller, Bietigheim, Germany

[73] Assignee: Durr - Dental KG., Germany

[21] Appl. No.: 534,686

[22] Filed: Dec. 19, 1974

[30] Foreign Application Priority Data

Dec. 20, 1973 Germany ..... 7345185[U]

[51] Int. Cl.[2] ..... G03D 13/00; F26B 13/00

[52] U.S. Cl. ..... 354/299; 34/156; 134/122 P; 354/322

[58] Field of Search ..... 354/299, 308, 315, 316, 354/319, 320, 321, 322; 134/64 P, 122 P; 34/155, 156, 160

[56] References Cited

U.S. PATENT DOCUMENTS

| | | | |
|---|---|---|---|
| 1,656,522 | 1/1928 | Josepho | 34/156 X |
| 3,000,288 | 9/1961 | Winnek | 354/299 |
| 3,060,829 | 10/1962 | Leighton et al. | 354/299 |
| 3,372,630 | 3/1968 | Schmidt | 354/321 X |
| 3,405,627 | 10/1968 | Day et al. | 134/64 P |
| 3,532,048 | 10/1970 | Hope et al. | 354/320 X |
| 3,760,705 | 9/1973 | Miller | 354/322 |
| 3,769,897 | 11/1973 | Zwettler et al. | 354/322 |
| 3,839,040 | 10/1974 | Goldstein | 354/321 X |

*Primary Examiner*—Fred L. Braun

*Attorney, Agent, or Firm*—Robert E. Burns; Emmanuel J. Lobato; Bruce L. Adams

[57] ABSTRACT

An X-ray film processor comprises a developing station, fixing station, rinsing station and drying station compactly arranged in a casing. Gear driven rollers transport the films continuously from a feed slot at the front of the casing, through the processing and drying stations and out of a discharge slot which faces forwardly but is above and back of the feed slot. The films are discharged onto an illuminated viewing screen located above the developing and fixing stations. The transport rollers are arranged in sets, one for each of the processing stations, which can be readily removed as a unit for cleaning, servicing or replacement. A system for continuously supplying fresh water to the rinsing station during operation prevents entry of contaminants back into the supply line. The drying station is located above the rinsing station and has a single heater and single fan so arranged in cooperation with the transport system as to dry both sides of the films.

14 Claims, 15 Drawing Figures

Fig. 6
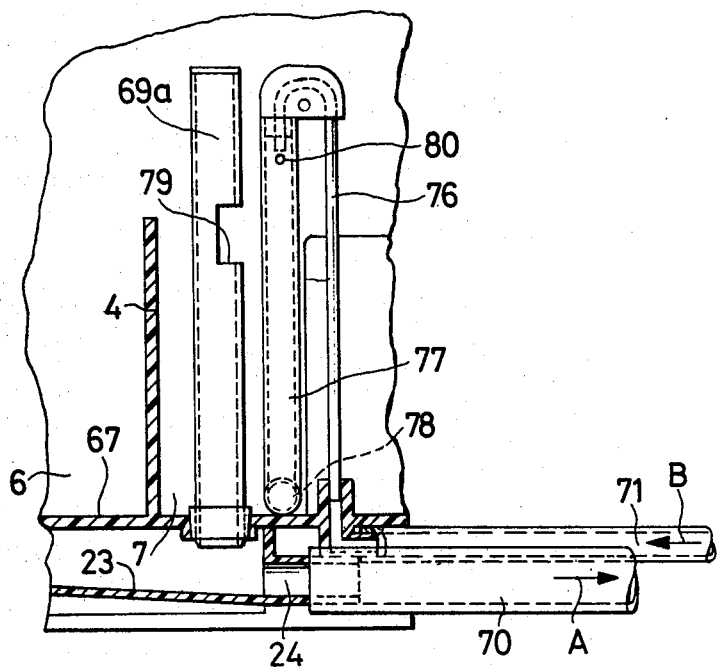
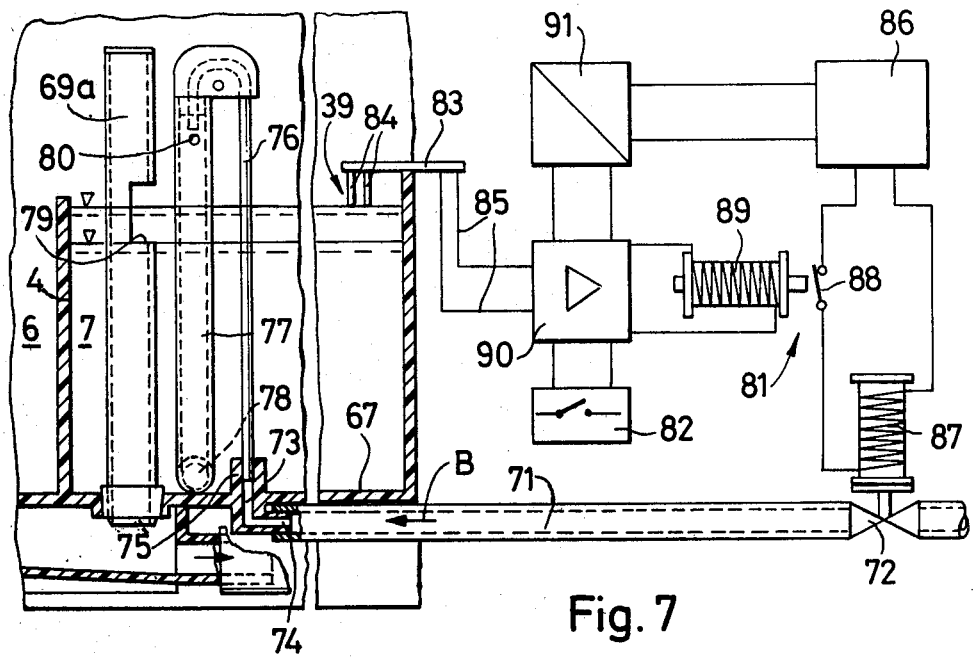
Fig. 7

96a
54
49
96
46
97
XII
XII
42
98
46,47
93
93
102
42

X-RAY FILM PROCESSOR

BACKGROUND OF INVENTION

X-ray film processors are known which have a plurality of processing stations for the wet processing of X-ray films, followed by a drying station for drying the processed films, as well as transport means for transporting the film through the processing stations and the drying station from a film loading point to a film discharge point.

Film processors of this type are employed especially in dentists' practices in order to automatically process the X-ray pictures often made of the area to be treated prior to the actual treatment of a patient. Such films are "cut" or piece films as distinguished from a continuous film strip. The X-ray films, exposed by means of an X-ray apparatus, are fed into the film processor at the film loading point; in the film processor, the transport means advances them through the various, successive processing stations, through a drying station that follows, and then to the film discharge point.

SUMMARY OF INVENTION

It is an object of the present invention to create an X-ray film processor which requires a minimum of space. An advantage of the solution according to the present invention is the fact that the film loading point and the film discharge point are arranged facing the same side of the processor, permitting the processor to be set up only a slight distance away from a wall.

It is a further object of the present invention to create an X-ray film processor which is as easy as possible to operate. An advantage of the processor according to the invention is the fact that the liquid baths can be operated for long periods of time without maintenance in that measures are provided to circulate the developer bath and the fixer bath; in addition, hot air from the drying station is prevented from reaching the area of the developer bath and the fixer bath; moreover, it is ensured that condensates rising from the above-mentioned baths are returned thereto; in addition, precise control of the temperature of the developer bath and the fixer bath is provided; and moreover, an automatic supply of fresh water for the rinsing station is also provided, whereby at the same time means are provided through which the supply of water is automatically switched off in the event of any malfunctioning.

A further object of the present invention is the creation of an X-ray film processor which is of the simplest possible design and which comprises dependably functioning individual components. An advantage of the X-ray film processor according to the present invention is the fact that only one heater and one electric fan are required for supplying hot air to the drying station, whereby guide means are provided for hot air, the guide means being designed in such a manner that one single flow of hot air is blown against both the front and the rear sides of the X-ray film, thereby drying it.

A further advantage of the present invention is the fact that merely one single motor, arranged in the rear section of the processor's casing, is provided for the drive of the processor, the motor being connected with the individual transport means by means of gear and worm gear arrangements which are designed in such a manner that the individual roller sets can be removed easily.

A further advantage of the processor according to the invention is the fact that, when the processor is not in operation, the formation of crystals from the chemicals baths is avoided on those rollers which are not constantly wetted with liquid. In an advantageous manner, the processor according to the invention provides for so-called preliminary squeezing roller pairs in front of the usual squeeze rollers, with the preliminary squeezing roller pairs squeezing off a large portion of the liquid from the X-ray film before the film ever reaches the actual squeezer rollers. The actual squeezer rollers, which are arranged outside the area of the liquid of the individual baths, are thus virtually always dry, and no crystals can therefore from on them. Those crystals which are formed on the preliminary squeezing rollers while the processor is not in operation are dissolved again when the processor is put into operation again, as they immerse in the liquid.

it is a further object of the invention to create a possibility for immediate viewing of the processed film. In this connection, it should be pointed out that the X-ray processor according to the present invention can be employed not only in a darkroom, but also under normal daylight conditions through the employment of an attachment, or daylight hood, for unpacking the exposed film and inserting it into the processor. In an advantageous manner, provision is further made for the film discharge point to be set back relative to the film loading point and for a collecting surface to be located between the film discharge point and the film loading point and for the collecting surface to be equipped as a film viewing station with a viewing screen which is illuminated from beneath. This provides the advantage that the film is not only loaded and discharged on the same side of the processor, but that the processed and dried X-ray films can be easily collected on the one single operating side of the processor, so that the operator must not wait until each X-ray film loaded into the processor is discharged from the processor again. The films discharged from the X-ray film processor according to the present invention can then be viewed and evaluated directly after processing is completed, without first having to be placed in a separate viewing apparatus or otherwise manipulated. This thus permits an immediate check of the quality of the processed X-ray film, for example, without any bothersome expenditure of time or travel and without the operator having to twist his or her head in order to be able to view the film against one of the sources of light usually located at the ceiling.

BRIEF DESCRIPTION OF THE DRAWINGS

The objects, characteristics and advantages of the invention will be more fully understood from the following description in conjunction with the accompanying drawings in which:

FIG. 6 is a section taken along line VI—VI in FIG. 2, schematically illustrating the fresh water supply means, the overflow pipe and the drain mains;

FIG. 7 is a schematic circuit diagram of the liquid level regulating means;

DETAILED DESCRIPTION OF THE DRAWINGS

Figure 1:
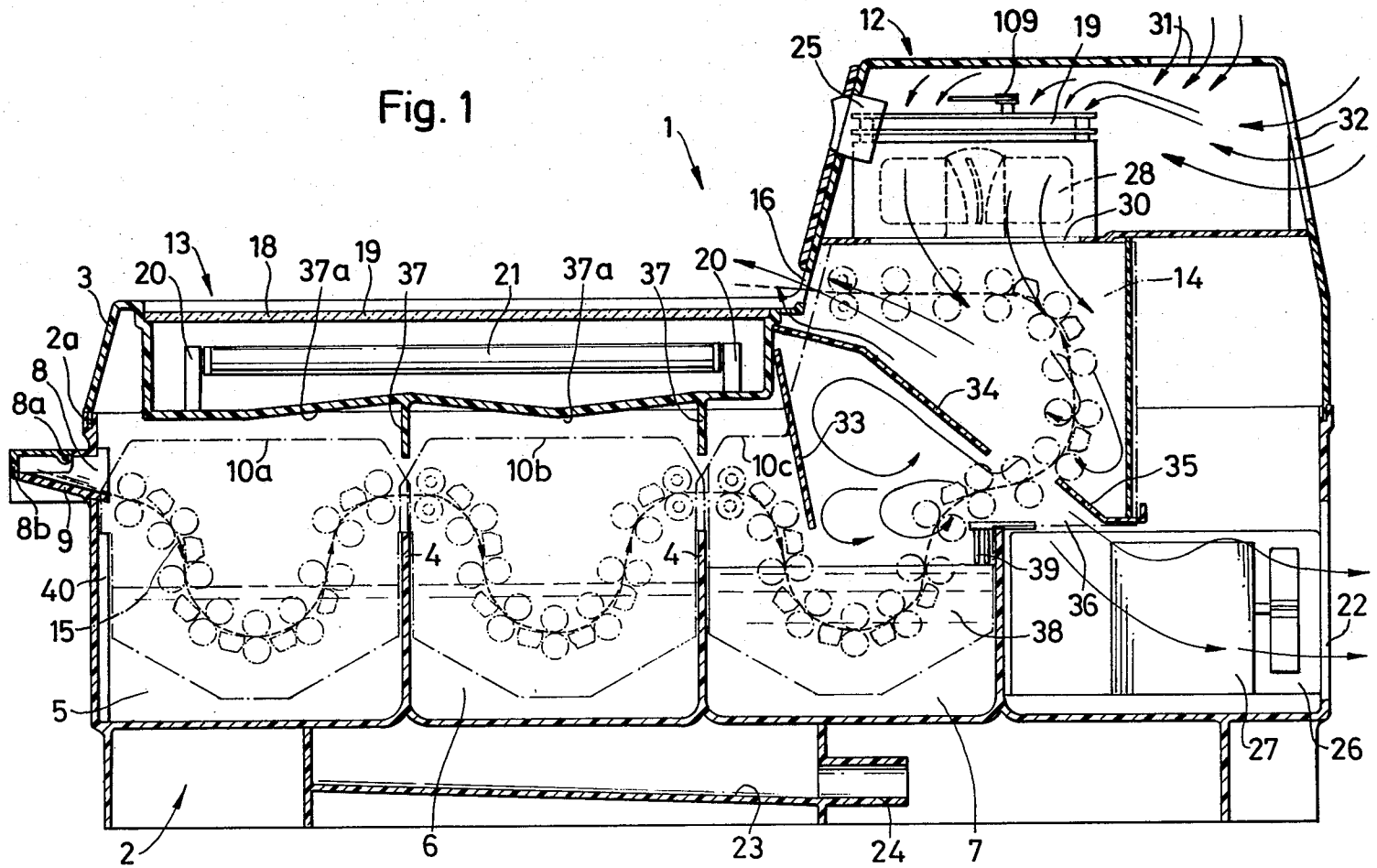
FIG. 1 is a schematic longitudinal section through a practical example of the X-ray film processor, with several details being illustrated only schematically or being left away entirely for reasons of clarity.
Figure 1A:
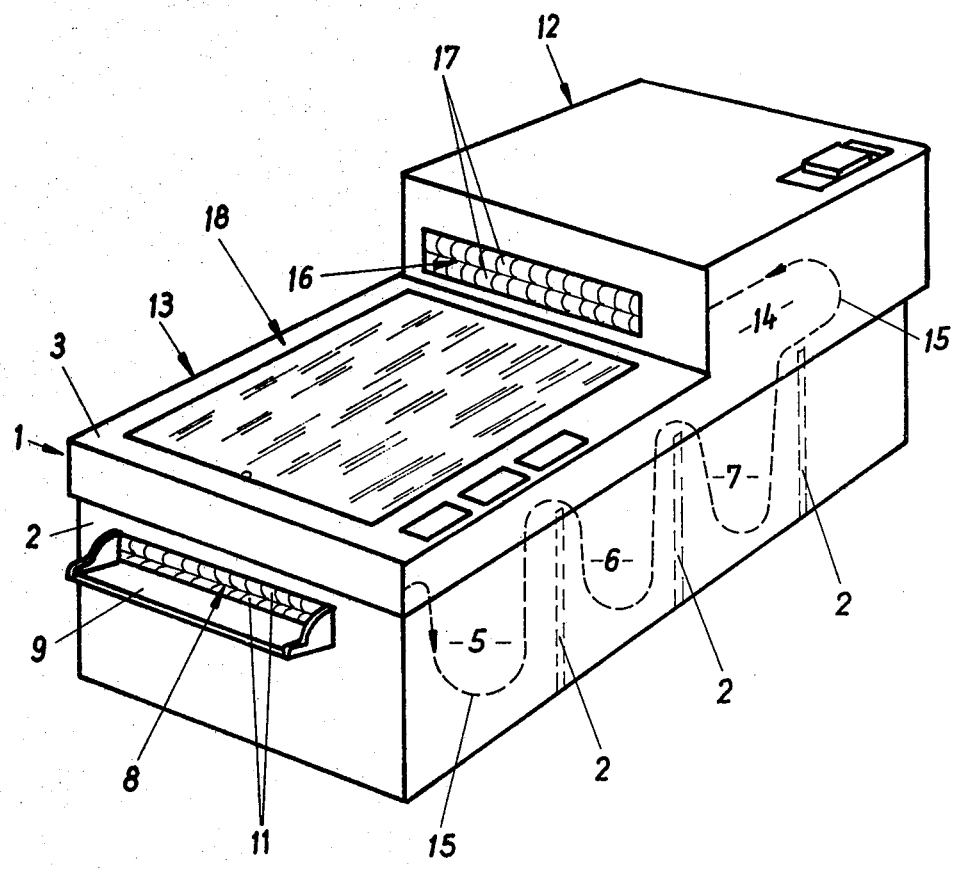
FIG. 1*a* is a perspective view of an X-ray film processor.

The X-ray film processor has a casing 1, comprising a base 2 and a top 3 placed thereon. Top 3 engages a peripheral groove 2a in base 2 in the nature of a tongue and groove connection. Partitions 4 divide base 2 into three tanks, representing the three different processing stations for the X-ray films to be processed, i.e., a developing station 5, a fixing station 6 and a rinsing station 7. The side of base 2 facing left in the representation according to FIG. 1 has a slot 8, which serves as the film loading point of the X-ray film processor. In order to simplify insertion of the films, there is a window-sill like projection 9 along the bottom edge of slot 8. Slot 8 can be closed by means of a flat 8b, which can be swivelled upward about an axle 8a.

Provided in the interior of the X-ray film processor are transport means, described in detail below, whose major components comprise interchangeably arranged roller frames 10a, 10b and 10c (indicated by dash-dotted lines in FIG. 1). The roller frames have pairs of rollers for transporting the film to be processed. The last pair of rollers of each roller frame comprises rubber squeezer rollers, which prevent the processing liquid in the respective processing stations from being carried over into the respective succeeding processing station and contaminating it.

Top 3 has a higher section 12 and a lower section 13. Located in higher section 12 is a further processing station, i.e., a drying station 14, containing heating means, to be described in more detail below, for heating the drying air, and a fan for the circulation thereof. In addition, roller frame 10c also contains transport means for transporting the X-ray films rinsed in rinsing station 7 through the drying station. As can be seen on the basis of the path of the X-ray films indicated by dashed line 15 in FIG. 1, the direction of travel of the X-ray films through the processor is reversed in drying station 14, so that they are now transported toward the film loading point. Located at the end of this path of travel in the end of higher section 12, which is adjacent to lower section 13, is a slot 16, which serves as the film discharge point.

The top 18 of lower section 13 of casing top 3 extending in front of film discharge point 16 forms a collecting surface for the processed X-ray films. Recessed into a rectangular section of the collecting surface is a viewing screen 19, which can be illuminated from beneath by means of a fluorescent lamp 21 arranged in holders 20.

Attached through an aperture 22 on that end of base 2 which is on the opposite side from the end containing slot 8 are (unillustrated) supply lines. These are electrical lines, as well as a waste-water connection. The waste-water connection is attached to the water drain illustrated schematically in FIG. 1 by means of a drain tray 23 and a connection 24. In addition, controls and indicator lamps for the various functions of the X-ray film processor are also arranged on top 3 of casing 1.

The X-ray film processor has only one operating side, i.e., the side facing the viewer. The films to be processed are inserted into the processor at film loading point 8 in base 2 of casing 1, pass through the various processing stations therein, and, after having reversed direction, are discharged again at film discharge point 16 in upper section 12 of top 3 of casing 1, as viewed from the operating side. Taking into consideration a certain amount of space required for the connecting lines, the end of the processor facing away from the viewer can thus be pushed relatively close to a wall. Other items or equipment can be located on either side of the processor. Because collecting surface 18, located toward the operating side in front of film discharge point 16, is equipped with a viewing screen 19 which can be illuminated from beneath, the processed X-ray film arriving there can be viewed and evaluated immediately, without having to be placed in a separate viewing apparatus or held up by hand against a source of light arranged at the ceiling. If the processor is set up in a darkroom, light-sensitive items must naturally be protected before the illumination is switched on. However it is especially advantageous if this arrangement is provided with an attachment (FIG. 14) which permits the X-ray films to be unpacked in a "mini darkroom". A processor equipped with an attachment of this type need not be operated in a darkroom. The arrangement with viewing screen 19 is especially favourable in an application of this type.

Arranged in a section 26 of base 2 of casing 1 is a drive motor 27, which drives all rollers disposed in roller frames 10a, 10b and 10c. As can further be seen from FIG. 1, an electric fan 28 is arranged above drying station 14 and a flat-design heater 29 above electric fan 28. Disposed beneath fan 28 in top 3 of casing 1 is an aperture 30, through which air is sucked in from air inlets 31 and 32 through heater 29 as shown by the indicated arrows and then advanced to the interior of drying station 14. Disposed in drying station 14 are baffles 33, 34 and 35, as well as rear wall 35a, which provide guidance of the hot air in drying station 14 in accordance with the arrows indicated in FIG. 1. The hot air egresses from drying station 14 through both slot 16, serving as the film discharge point, as well as an aperture 36. As can be seen from dashed line 15 representing the path of the film through the processor, the film is thus subjected to hot air on both sides of the film and dried by means of one single heater, whereby reference is made to the fast that the X-ray film to be processed does not comprise a continuous strip of film, but individual sections of film, as can be seen from FIGS. 12 and 13. A portion of the flow of hot air can therefore always flow against the bottom of the film from the front and rear ends of the film, as viewed in the direction of travel of the film through the processor. The film sections are often of changing and differing size.

As can further be seen from FIG. 1, the underside of top 3 has inwardly extending ribs 37 and inclined dripping surfaces 37*a*, the ribs 37 extending above and along respective partitions 4. As an explanation of the function of these ribs and inclined dripping surfaces, it should be pointed out that the working temperature of the liquids in developing station 5 and fixing station 6 is on the order of between 75° F and 97° F. These temperatures result in considerable evaporation. The arrangement of ribs 37 and inclined dripping surfaces 37*a* is such that the condensate which forms on the bottom of top 3 is collected and returned to the developing and fixing stations, respectively, thereby preventing excessive concentrations of the chemicals in the stations, which would necessitate frequent addition of liquid.

In addition, further evaporation of liquids in developing station 5 and fixing station 6 is prevented by the above described air circulation system in the drying station, as the flow of warm air in drying station 14 is prevented from entering the area of the developing station and the fixing station, which could result in increased evaporation of liquids and increased oxidation through the oxygen in the air.

In addition, the water 38 generally present in rinsing station 7 is shown schematically in FIG. 1. As will be explained below, fresh make-up water is constantly added to rinsing station 7 when the X-ray film processor is in operation. The excess water flows through an overflow pipe (not illustrated in FIG. 1) and into water drain 23; in the event that removal of the water should not function for any reason, there are contact means 39, which switch off the supply of fresh water by means of a switching arrangement, described in more detail in FIG. 7.

In addition, (unillustrated) circulation pumps are provided for developing station 5 and fixing station 6, which provide circulation of the baths in order to avoid fluctuations in the concentration thereof.

Figure 2:
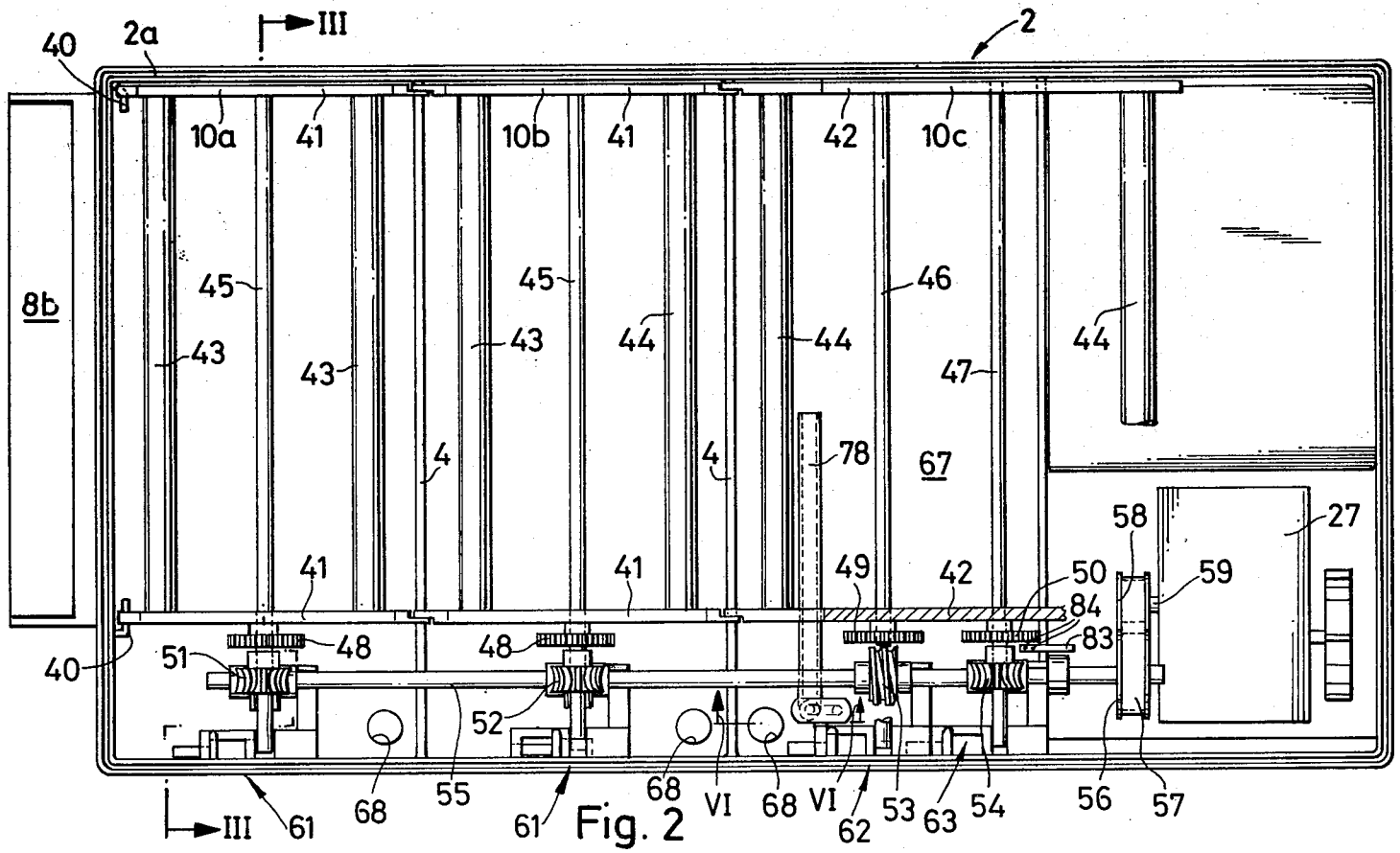
FIG. 2 is a top view of the arrangement shown in FIG. 1, with the top removed.
Figure 4:
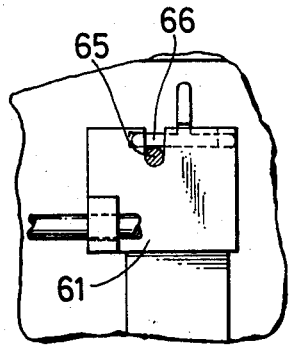
FIG. 4 is a partial section taken along line IV—IV in FIG. 1, showing the holding means for the roller sets, with a slide in the closed position.
Figure 5:
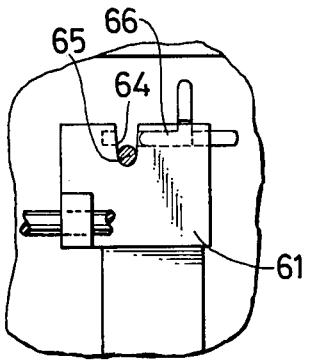
FIG. 5 is a representation according to FIG. 4, whereby however the slide is shown in the open position.

As can be seen from FIG. 2, roller frames 10*a* and 10*b*, which are designed in the same manner, and roller frame 10*c* are inserted removably in base 2 and are in a supporting relationship with stops, of which only a portion is illustrated and designated 40. Roller sets 10*a* and 10*b* have end panels 41. Roller set 10*c* has end panels 42. The lower end panel 42 in the representation according to FIG. 2 is shown as a section. End panels 41 and 42 are connected one with the other by means of distance rods 43 and 44. Also arranged in the roller frames are shafts 45 (roller set 10*a*, 10*b*) as well as 46 and 47. Shafts 45, 46 and 47 drive drive rollers and/or squeeze rollers (not illustrated in FIG. 2) in the roller frames, by means of which the films to be processed are advanced through developing station 5, fixing station 6, rinsing station 7 and drying station 14. The lower ends of the shafts, as shown in the representation according to FIG. 2, extend outside through end panels 41 and 42, and have gears 48, 49 and 50 which mesh with pinions 48*a*, 48*b* etc to drive the transport rollers and further have worm gears 51, 52 and 54 which mesh with worms 53 on a common shaft 55. Shaft 55 has a pulley 56, which is in a driving relationship with a pulley 58 on shaft 59 of drive motor 27 by means of a belt 57. Shaft 55 is designed as a worm shaft. As can be seen from FIG. 3, the individual rollers disposed in the roller frames are driven by means of gears 48*a* and 48*b* which mesh with gear 48. Holders 61, 62 and 63, which are attached to the interior wall of base 2 and have support grooves 64 in which an end 65 of a shaft can be inserted and which can then be closed by means of slides 66, for arresting the roller sets. FIG. 4 shows a slide 66 of this type in the closed position, while FIG. 5 shows a slide of this type in the open position.

Figure 3:
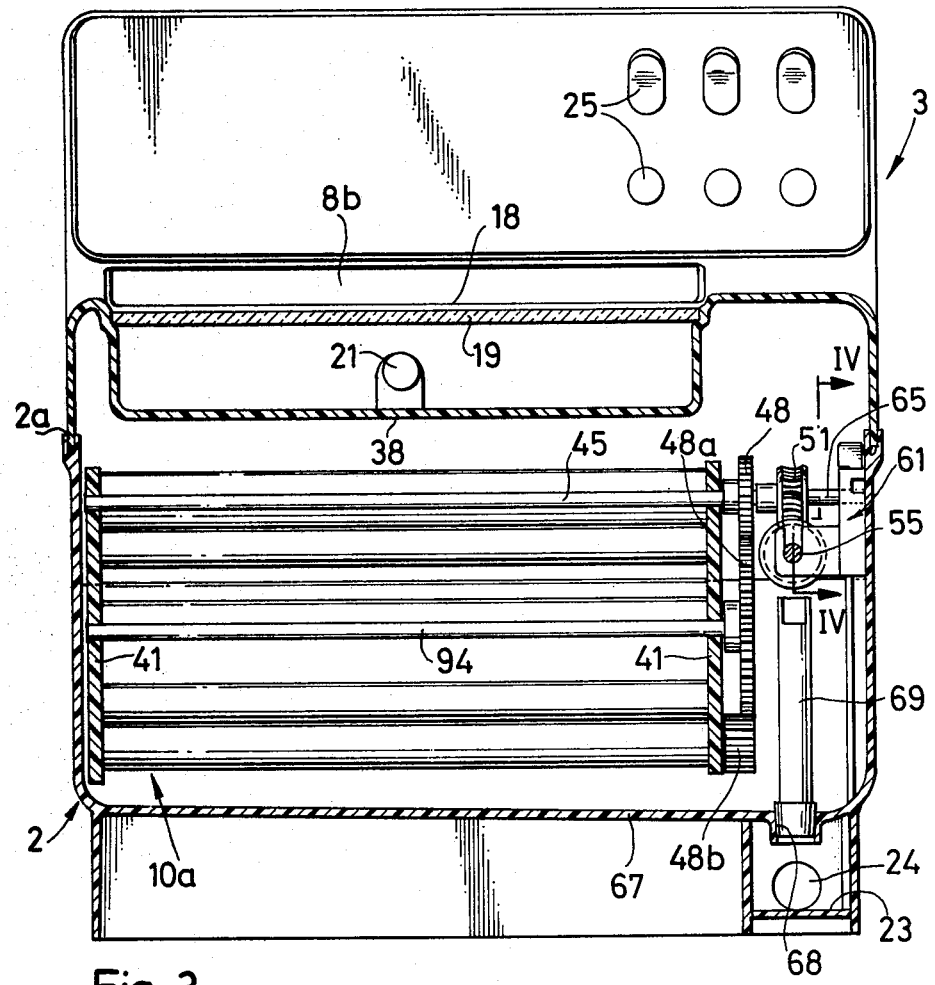
FIG. 3 is a section through the arrangement shown in FIG. 2, the section being taken along line III—III, however with the top in place. Here also, some parts are only illustrated schematically or left away entirely for reasons of clarity.

As can be seen from FIG. 3, the floor 67 of base 2 is inclined downward toward a drain opening 68. A respective overflow pipe 69 is inserted in this drain opening, with the level of the liquid in the individual stations being determined by the effective height of overflow 69. Drain opening 68 discharges into water drain 23.

Illustrated in the arrangement shown in FIG. 6 is an overflow pipe for rinsing station 7, designated 69*a*. Also indicated is a drain line 70, from which the liquid, coming from water drain 23, can flow in the direction of arrow A. The water is supplied by means of a water line 71, from which water can be added to the arrangement. Water line 71 can be closed by means of a solenoid valve 72. Formed in floor 67 is a passage 73, which has a connection 74, onto which water line 71 can be placed. Inserted in a further connection 75 is a pipe 76, whose upper end is angled 180° and opens into a further pipe 77, which has a discharge section 78 extending toward floor 67. Provided above the water level in pipe 77, the height of the water level being determined by an opening 79 in overflow pipe 69*a*, is an aperture 80, which prevents water from rinsing station 7 from flowing back into the water line, from which the water is supplied in the direction of arrow B. The functions in such a manner that solenoid valve 72 is opened by means of a relay 81 when a switch 82 is actuated. Switch 82 is actuated automatically when the processor is switched on through manipulation of one of controls 25. The water supplied through water line 71 flows out of discharge section 78. The water level is kept constant, as the excess water flows off continuously through opening 79 in overflow pipe 69*a*. Above-mentioned contact means 39, which have two contacts 84 on a contact plate 83, are provided for controlling the water level in the rinsing station. A voltage, such as 24 V, is supplied to the contacts through leads 85. When the liquid level reaches the two contacts, they are conductively connected by the water, whereby the supply of water is stopped when relay 81 closes *c* solenoid valve 72. The relay arrangement has a switching arrangement 86, which is supplied with mains voltage, for example 220 V. The actual actuation of solenoid valve 72 is by means of a coil 87, whose lead contains a switch 88 which can be actuated by means of a relay 89. The supply of current to coil 89 is controlled by means of a switching arrangement 90, which is supplied with a control voltage, for example 24 V, through electrical means 91 on the one hand and which is given switching orders by means of leads 85 and switch 82 on the other.

Figure 8:
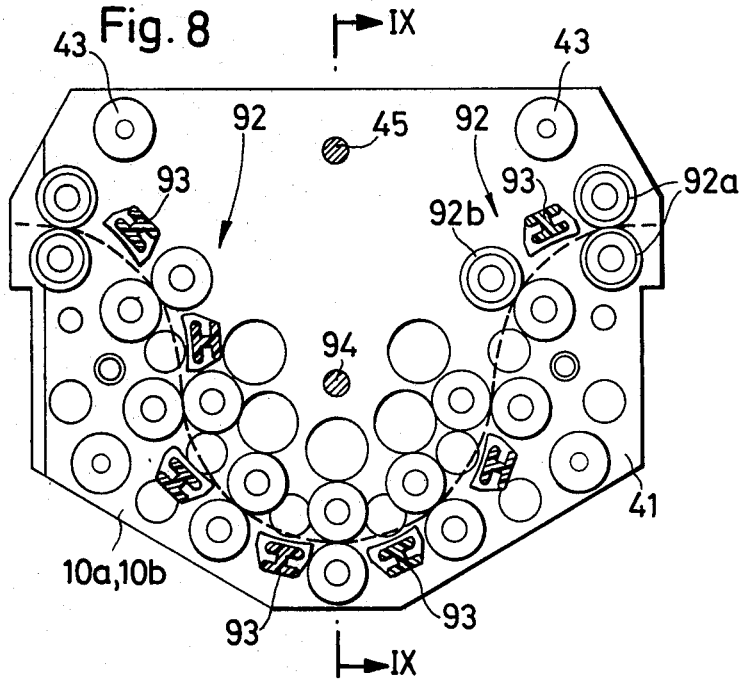
FIG. 8 is an end view of a set of rollers which can be inserted into the developing station and/or the fixing station.
Figure 9:
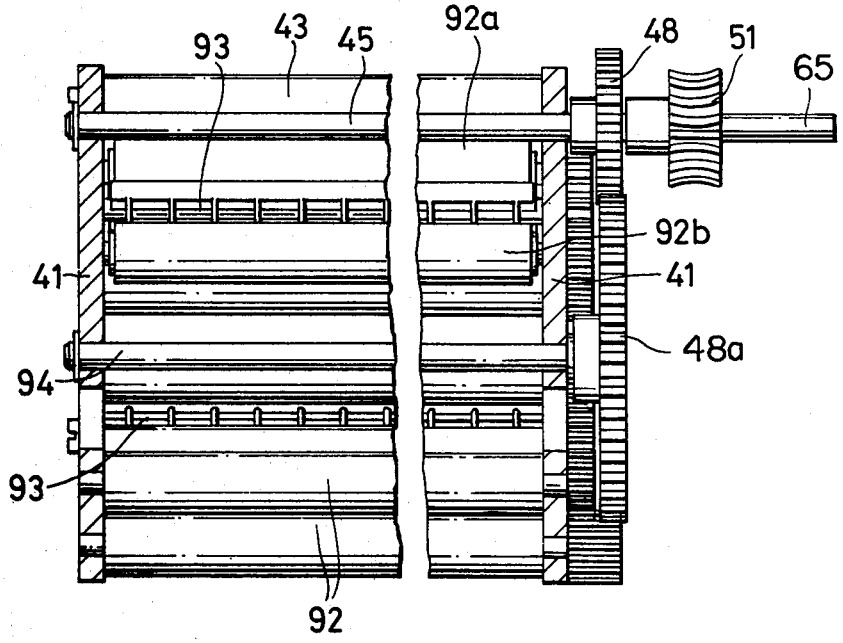
FIG. 9 is a schematic cross section of the arrangement shown in FIG. 8, taken approximately along line IX—IX in FIG. 8.

The representation according to FIG. 8 shows an end plate of roller set 10*a* or 10*b*. Roller sets 10*a* and 10*b* are designed in the same manner. Disposed in the roller frames is a plurality of rollers 92, with individual rollers being designed as drive rollers, transport rollers and squeezer rollers. The squeezer rollers, which are designated 92*a*, are preceded by a pair of preliminary squeezing rollers 92*b* which are partially immersed but with the nip of the rollers above the liquid level. Through the effect of the preliminary squeezing rollers, which have a resilient support, a large portion of the liquid is squeezed out of the film, with only a portion of the liquid to be squeezed out remaining for main squeezer rollers 92*a*. The squeezer rollers are provided especially in order to prevent chemicals from being carried over from one station to another. Since main squeezer rollers 92*a* are virtually always dry, no crystals form on them, as would normally be the case on rollers which are wetted with liquid developer or liquid fixer. However crystals of this type do form on the preliminary squeezing rollers when they do not move. These crystals are dissolved again when the rollers move however. These problems always occur in processors which are used only occasionally or with interruption, as considerable quantities of crystals form on the rollers and cannot be removed again when the rollers are dry. Shown by dash lines in FIG. 8 is the path of the film to be processed through roller sets 10*a* and 10*b*. In addition to the rollers, there are guide means 93, which ensure reliable infeed of the film between individual pairs of rollers. Arranged below shaft 45 is another shaft 94, which is driven by means of gear 48 via gear 48*a*.

The effect of the guide means ensures, especially with films of small size, that the film is properly guided through the X-ray film processor. Rollers 92, 92*a* and 92*b* are driven by means of a plurality of gears meshing one with the other, a portion of which are disposed as planetary gears.

Figure 10:
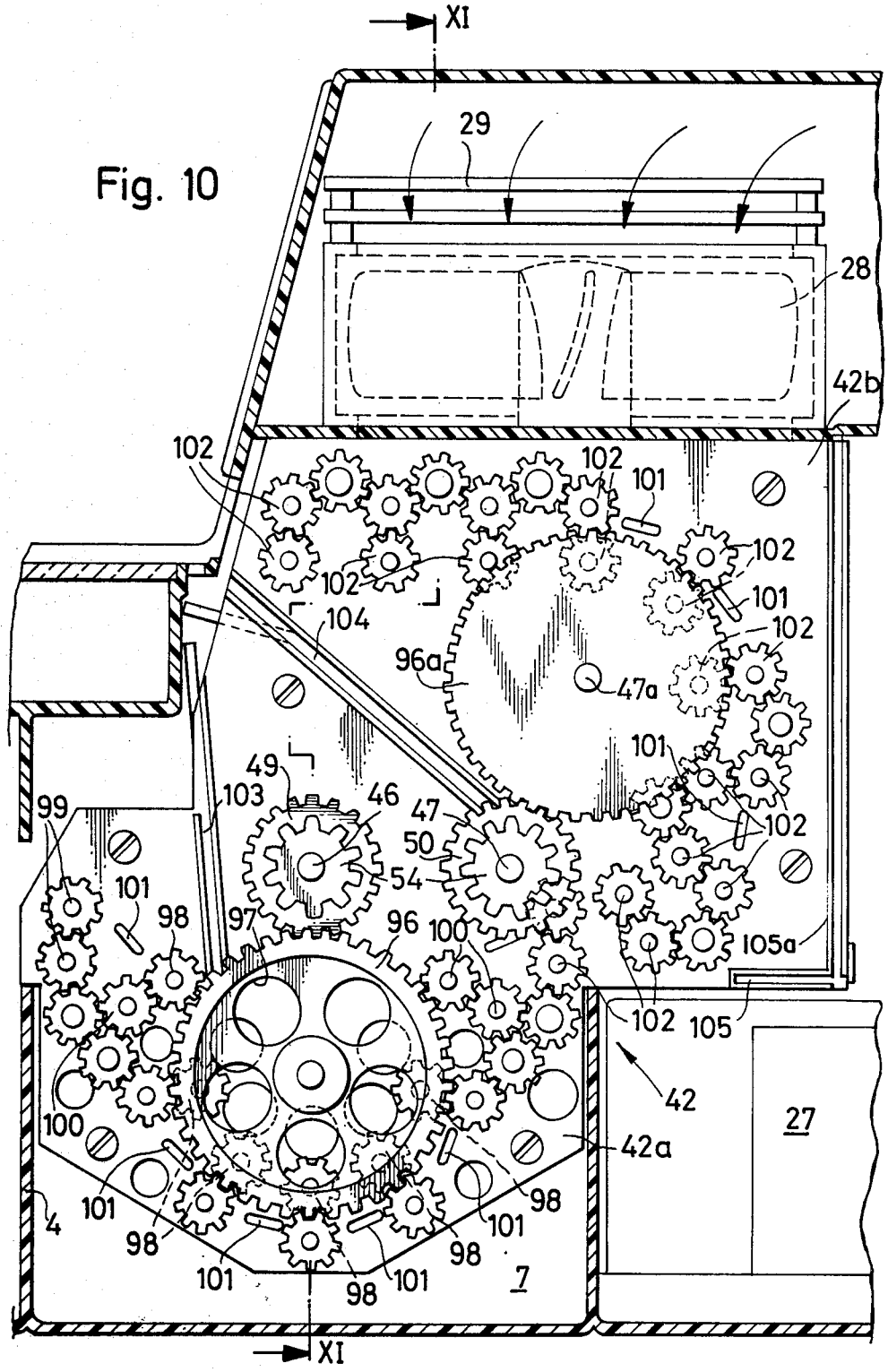
FIG. 10 is a schematic side view of the common set of rollers intended for the rinsing station and the drying station.

The arrangement according to FIG. 10 shows an end panel 52 of roller set 10*c*. The lower section 42*a* holds rollers, guide means and squeezer rollers for rinsing station 7. In principle, the design of this arrangement corresponds to that shown in FIG. 8. Rotatably driven shaft 46 (cf. FIG. 2) drives, by means of gear 49, a sun gear 96 with circular recesses 97, around which planetary gears 98 are disposed in the same manner as with the above-described roller sets, with planetary gears 98 also meshing with additional gears. Driven by means of planetary gears 98 are pairs of transport rollers (not designated individually for the sake of clarity), as well as a pair of preliminary squeezing rollers 99 and squeezer rollers 100. In addition, there are also guide means here, arranged in recesses 101, which correspond to guide means 93. Provided in upper section 42*b* of end panel 42 is a further arrangement for guiding and transporting the X-ray film to be processed through the drying station. Here, also, there is a plurality of transport rollers. The transport rollers are driven via a plurality of gears, meshing one with the other, by a sun gear 96*a* which has a shaft 47*a* and with which driven gear 50 (FIG. 2) meshes. Also shown in FIG. 10 are guide slots 103, 104, 105 and 105*a* for holding plastic baffles 33, 34 and 35, as well as rear wall 35*a*.

Figure 11:
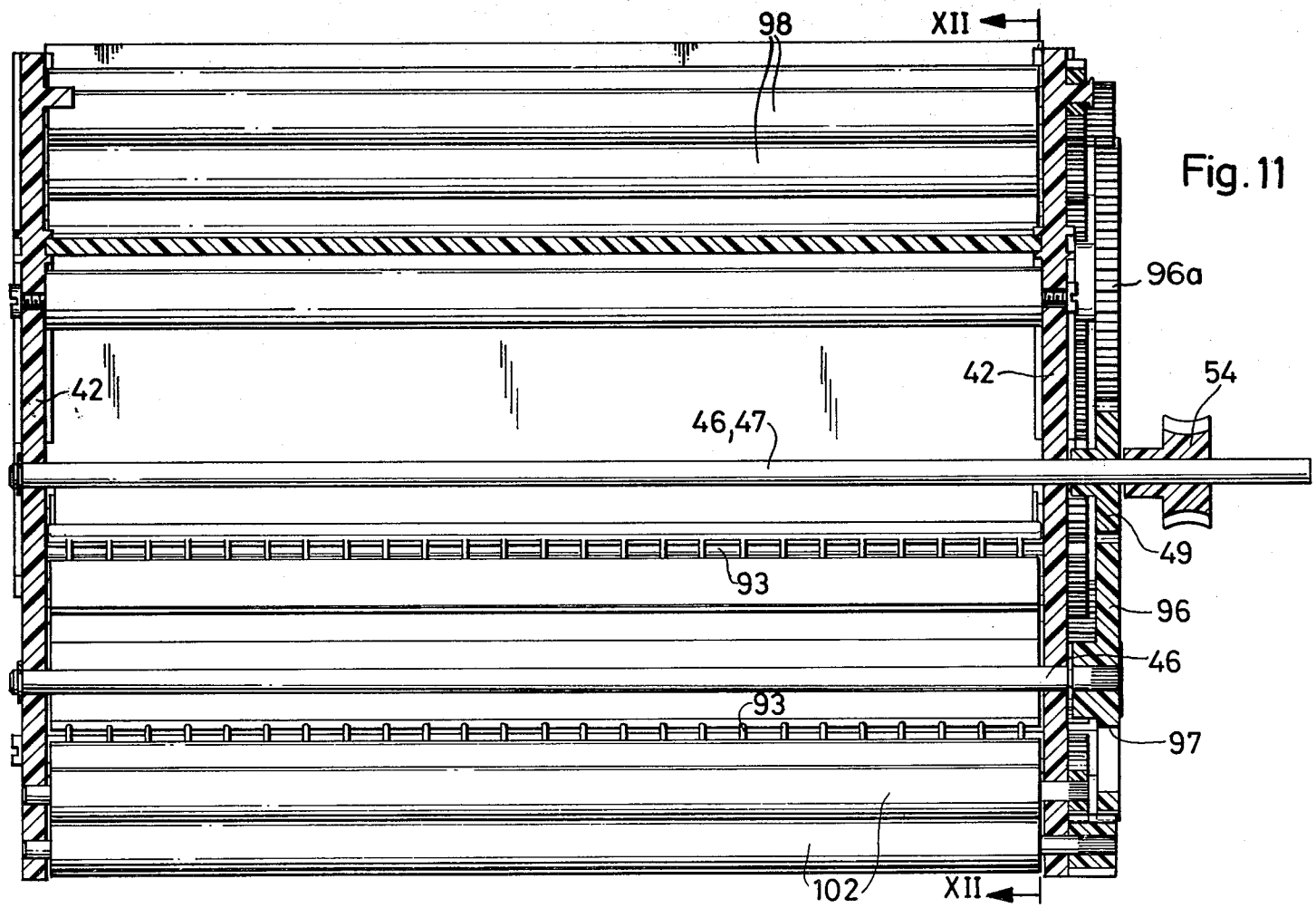
FIG. 11 is a section taken along line XI—XI in FIG. 10.

The arrangement shown in FIG. 11, which represents a schematic section taken approximately along line XI—XI in FIG. 10, is self-explanatory and therefore requires no further description.

Figure 12:
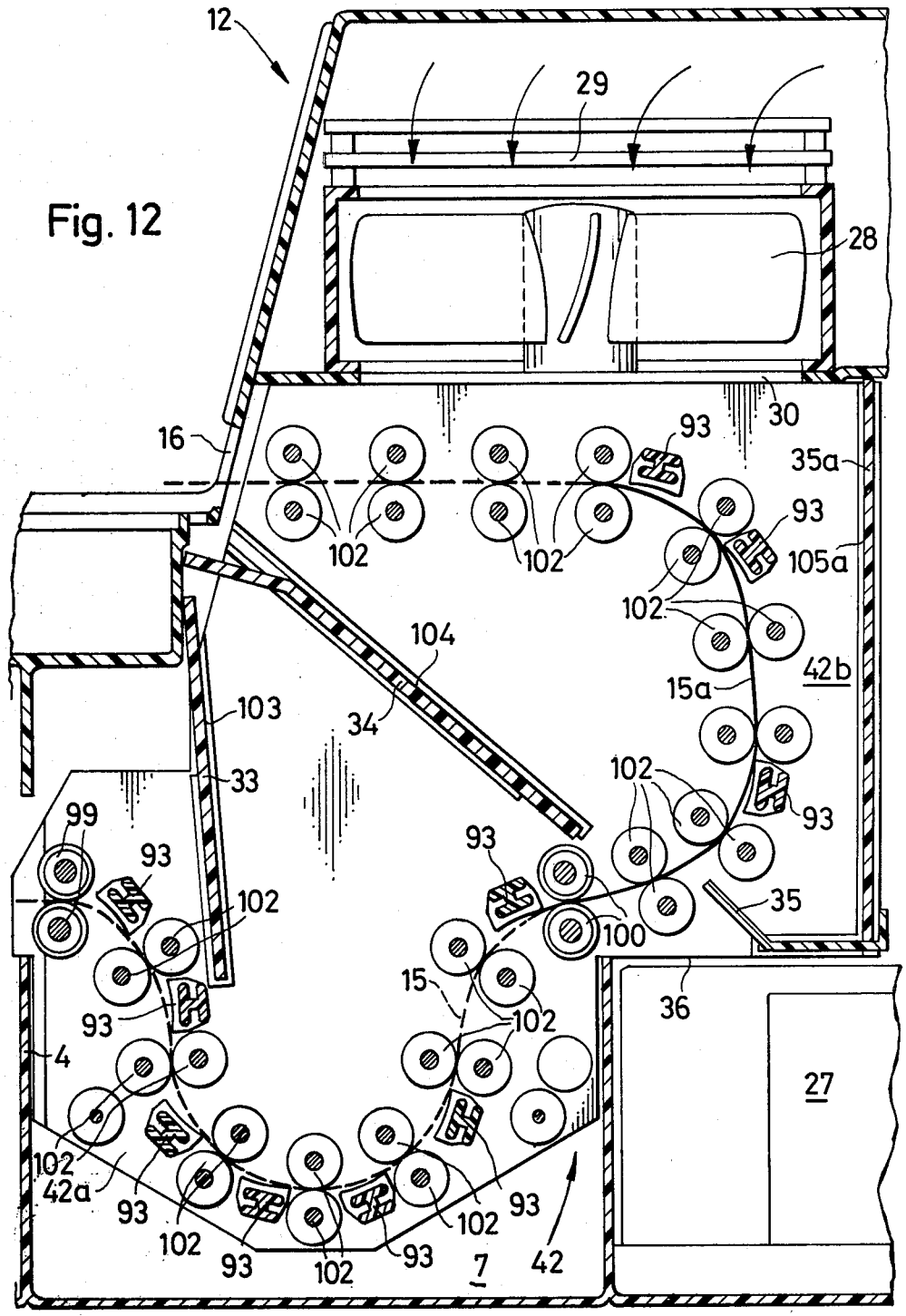
FIG. 12 is a section taken approximately along line XII—XII in FIG. 11.
Figure 13:
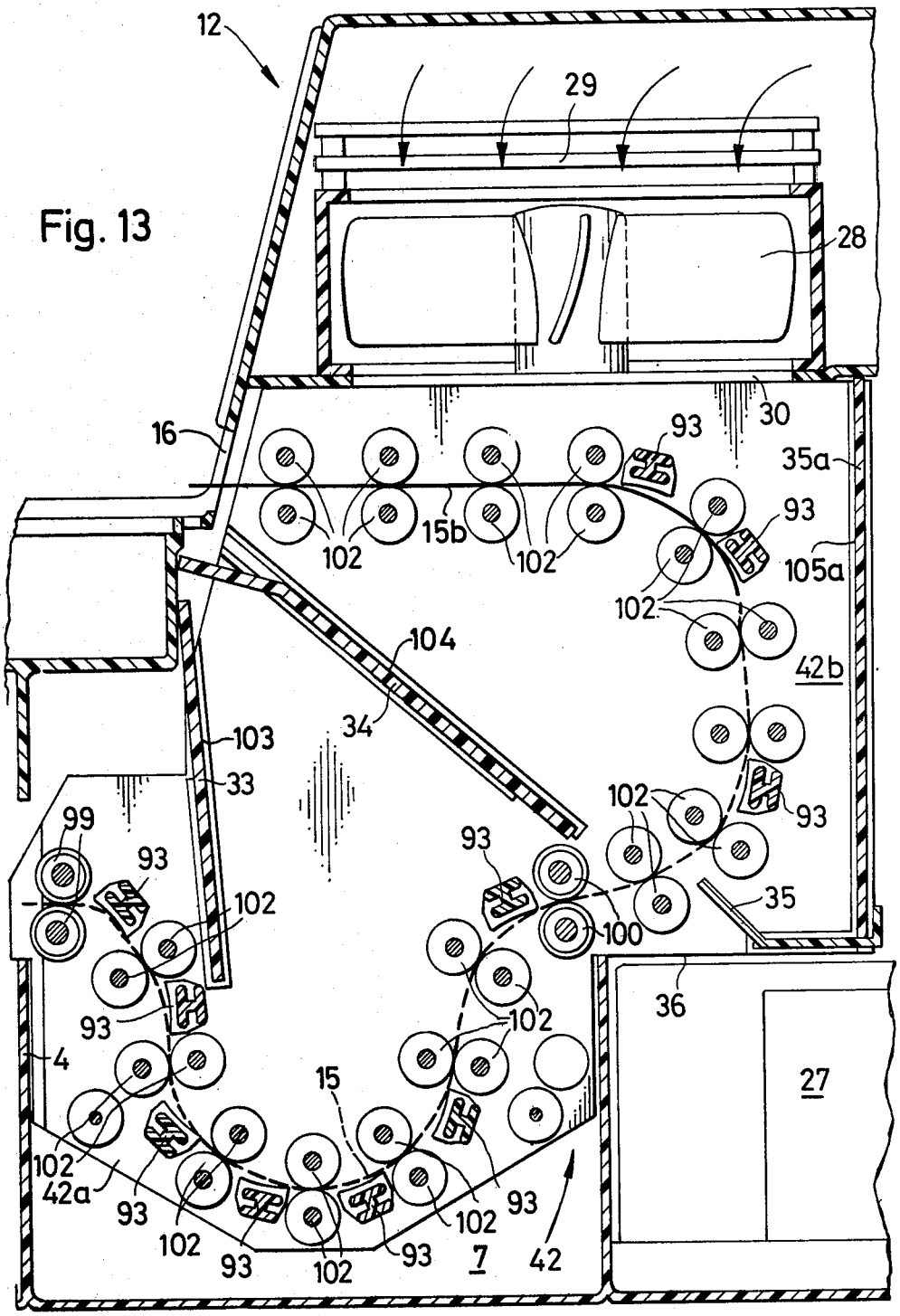
FIG. 13 is a representation according to FIG. 12, in which however a film to be processed is shown in a different location.

Shown schematically and in a larger scale in FIGS. 12 and 13 is the area of rinsing station 7 and drying station 14, generally corresponding to the right portion of FIG. 1 and, in addition, generally taken along line XII—XII in FIG. 11. The path of the films is shown by dashed lines and designated 15. In addition, a film to be processed is illustrated in various positions and is designated 15*a* in FIG. 12 and 15*b* in FIG. 13. As can be seen from FIGS. 12 and 13, the path of the film to be processed is reversed approximately 180° in the drying station and, in addition, the hot air sucked in through heater 29 by electric fan 28 is blown against both sides of film 15*a* and 15*b* to be processed, so that the processor according to the invention requires only one heater and one fan. In viewing FIG. 12, it can be seen that the hot air is supplied primarily to that side of film 15*a* which is on the left side of the representation selected according to FIG. 12. When the film is advanced, in a later movement phase the hot air will primarily be blown against that side of the film facing upward in FIG. 13, which is on the opposite side of the film from the initially mentioned side.

Beneath developing station 5 and fixing station 6 are (unillustrated) heaters, which heat the developer bath and the fixer bath. Arranged in a corner of the developer bath is an (unillustrated) temperature sensor, which is designed as an N.T.C. (negative temperature control) element. This permits the temperature to be controlled with an accuracy of approx. 0.2° F, which is of major significance in achieving an especially good film quality. A printed temperature control plate provided herefor is arranged in section 26 of the casing (not illustrated) and permits the temperature to be set if necessary.

Figure 14:
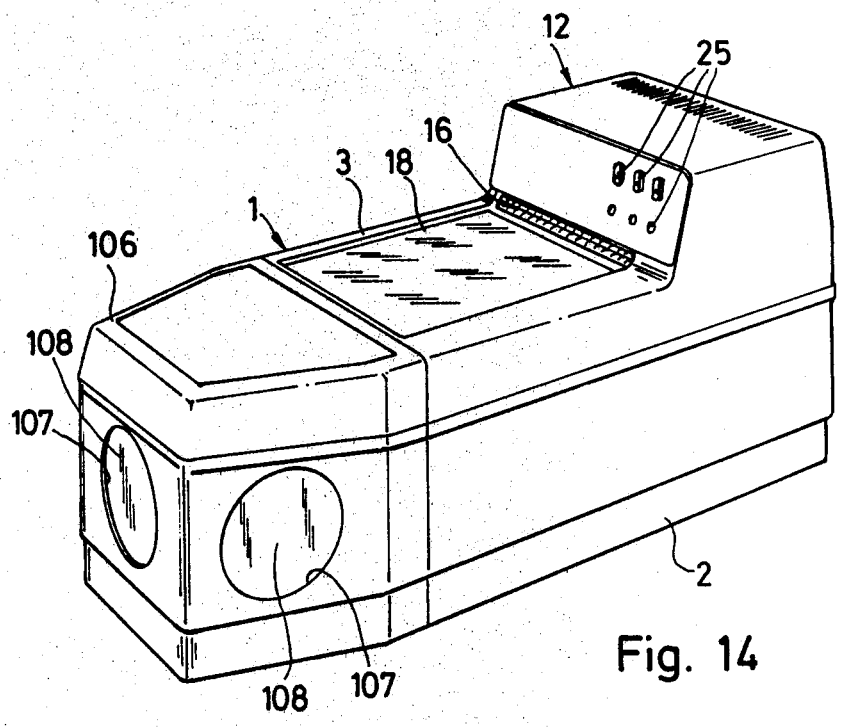
FIG. 14 is a schematic representation of the exterior view of a practical example of the X-ray film processor, having an attachment which permits the exposed X-ray film to be unpacked and inserted into the processor under daylight conditions.

Shown in FIG. 14 is a schematic representation of the exterior view of the practical example described in the drawings, whereby there is an attachment 106, which permits the exposed X-ray film to be unpacked under daylight conditions. The attachment comprises a box with openings 107, which are sealed by means of flexible, lightproof sleeves 108 or similar items. A film to be processed can be introduced into attachment 106 by hand by slipping it through sleeve 108, unpacked therein, and then inserted into the slot serving as film loading point 8. In order for the processor to operate, it is necessary for it to be switched on by means of controls 25 and for the chemicals baths in developing station 5 and fixing station 6 to be heated up. With the processor in operation, as described above the water in rinsing station 7 is continuously replenished. When the processor is switched on, circulation pumps for circulating the respective baths in developing station 5 and fixing station 6 also start simultaneously. The film is then first advanced through the developing station along dashed line 15 and developed there. The liquid developer is squeezed off by preliminary squeezing rollers 92*b* and main squeezer rollers 92*a* before the film to be processed reaches fixing station 6. After passing through fixing station 6, the film again passes through preliminary squeezing rollers 92*b* and then main squeezer rollers 92*a* before it is advanced to rinsing station 7 in accordance with dashed path 15. After passing through the rinsing station, the film is then advanced through drying station 14, whereby, through the arrangement of plastic baffles 33, 34 and 35, as well as rear wall 35*a*, both sides of the film are subjected to a flow of hot air and thereby dried, while the hot air is simultaneously prevented from entering the area of fixing or developing stations 5 or 6. The film finally egresses from slot 16, which serves as the film discharge point, and comes to rest on viewing screen 19, where, as a result of the illumination from beneath by means of fluorescent lamp 21, it can be viewed directly. It can be seen that because it was reversed the film leaves the processor on the side facing the loading side. It is possible to process films of differing size, including small sizes, as the film is prevented from being lost through the effect of guide means 93. The rollers are driven exclusively by means of gears, which permits dependable operation. It is practical for the gears to be of plastic. All moving parts are driven by means of drive motor 27, which can be designed as a gear motor and which acts on shaft 55, designed largely as a worm drive spindle. The temperature of the baths is kept at a constant level within narrow limits through the above-described control means, which results in good picture quality. The design of top 3 with ribs 37 and, especially, inclined dripping surfaces 37*a* provides separation of the individual baths one from the other on the underside of top 3 and causes the condensate to drip back into the baths again so that the concentration of the baths is not influenced thereby.

Because preliminary squeezing rollers 92*b* squeeze off the major portion of the liquid in each case, only a small portion of the liquid to be squeezed off remains for main squeezer rollers 92*a*. Thus, they are virtually always dry, and no crystals form thereon. The crystals which do form on the preliminary squeezing rollers while the processor is not in operation are dissolved again when the processor is in operation.

An especially favourable feature in the processor according to the invention is that the drain openings 68 in all tanks discharge into the same water drain 23. All electrical components, including the transformer provided for contact means 39, are arranged in rear section 26 of casing 1, with the exception of controls 25, heater 29 and electric fan 28. Also located above electric fan 28 is a thermostat 109, which serves to control the temperature in drying station 14 and prevent overheating, and thus damage to the processor or the film.

What I claim and desire to secure by Letters Patent is:

1. An X-ray film processor, comprising a plurality of processing stations for the wet development of X-ray films, said processing stations being arranged within a casing and being followed by a drying station for drying the processed films and transport means for transporting said films through said processing stations and said drying station from a film loading point to a film discharge point, said casing having a bottom, sides, ends and a top, with the individual processing stations in said casing, to wit a developing station, a fixing station and a rinsing station separated within said casing by partitions which with said bottom, sides and ends define tanks for developing, fixing and rinsing liquids respectively, said partitions extending up above the liquid level in said tanks, said transport means transporting said film up over said partitions in transporting said film from one tank to the next, said top of said casing having separators extending down from the top above said partitions, the lower edges of said separators being spaced from the upper edges of the respective partitions, and inclined dripping surfaces on the underside of said top of said casing, said dripping surfaces being inclined downwardly from said separators, said separators and inclined dripping surfaces being formed in such a manner as to cause any condensate precipatated onto said underside of said top of said casing to be returned to the tank of the respective processing station.

2. An X-ray film processor according to claim 1, wherein said separators extend down below the lowest portions of said dripping surfaces.

3. An X-ray film processor according to claim 1, wherein said transport means transporting the films out of said liquid and up over said partitions from one processing station to another, includes squeezer rollers arranged within the casing in the course of said transport means above the liquid level in order to prevent liquid from one processing station from being carried over into the following processing station, and a pair of preliminary squeezing rollers which are partially immersed in said liquid and hence wetted partially with liquid but which have their nip above the liquid level, preceding said squeezer rollers, said preliminary squeezing rollers causing the major portion of the liquid to be squeezed off, leaving said squeezer rollers virtually dry and thereby preventing the formation of crystals on said squeezer rollers.

4. An X-ray film processor, comprising a plurality of processing stations for the wet development of X-ray films, said processing stations comprising a developing station, a fixing station and a rinsing station arranged within a casing and followed by a drying station for drying the processed film and transport means for transporting said films through said processing stations and said drying station from a film loading point to a film discharge point, said drying station comprising a drying compartment located generally above said rinsing station and rearward of said developing and fixing stations, air inlet means at an upper portion of said compartment and air outlet means at a lower portion of said compartment, one single heating means and one single fan means disposed in an upper portion of said compartment to direct hot air downwardly onto films passing through said compartment, said transport means being arranged to change the direction of travel of said films as they pass through said compartment to present first one side and then the opposite side of said films to said hot air, and air baffle means in said compartment arranged in such a manner that the hot air circulating in said drying station is blown against both sides of said processed films to be dried as they advance through said drying station and is prevented for all practical purposes from reaching said fixing stations or said developing stations, said air baffle means comprising at least two baffles extending apart one from the other and being arranged beneath said film discharge point and directed downwardly, and a further, short baffle arranged generally in the same direction as one of said two baffles with a passage for said X-ray films provided between the two said baffles arranged in generally the same direction.

5. An X-ray film processor according to claim 4, having a thermostat disposed above said single heating means for said drying station for controlling the temperature in said drying station.

6. An X-ray film processor according to claim 4, wherein said transport means initially transports said films upwardly upon entry of said films into said drying compartment and then transports said films horizontally under said heating means and fan means to said discharge point.

7. An X-ray film processor according to claim 4, wherein said heating means is disposed above said fan means in such position that said fan means draws air down through said heating means and directs it toward said films as they are transported through said compartment.

8. An X-ray film processor, comprising a plurality of processing stations for the wet development of X-ray films, said processing stations being arranged within a casing and being followed by a drying station for drying the processed films, said processing stations comprising a developing station, fixing station and rinsing station sequentially arranged, said drying station comprising a drying compartment located generally above said rinsing station and rearwardly of said developing and fixing stations, air inlet means at an upper portion of said compartment and air outlet means at a lower portion of said compartment, one single heating means and one single fan means disposed in an upper portion of said compartment to direct hot air downwardly onto films panning through said compartment, and transport means for transporting said films through said processing stations and said drying station from a film loading point at the front of said developing station to a film discharge point at the front of said drying station and above said rinsing station, said transport means being arranged to change the direction of travel of said films as they pan through said drying compartment to present first one side and then the opposite side of said films to said hot air from said single heating means and single fan means, air baffle means in said drying compartment arranged in such manner as to direct hot air to both sides of said films and to prevent for all practical purposes said hot air from reaching said developing stations, said air baffle means comprising at least two baffles extending apart one from the other and being arranged beneath said film discharge point and directed downwardly, and a further short baffle arranged generally in the same direction as one of said two baffles with a passage for said X-ray films provided between the two said baffles arranged in generally the same direction, a horizontal collecting surface for said processed X-ray films being provided above said developing and fixing stations and in front of said drying station, said collecting surface comprising a translucent viewing screen disposed above and spaced from said developing and fixing stations, and lighting means disposed between said viewing screen and said developing and fixing stations to illuminate said viewing means from below.

9. An X-ray film processor according to claim 8, wherein said casing has a recessed top portion overlying said processing stations, said top portion having therein a recess under said viewing screen, said lighting means comprising a horizontally disposed tubular lamp disposed in said recess.

10. An X-ray film processor, comprising a plurality of processing stations for the wet development of X-ray films, said processing stations being arranged within a casing and being followed by a drying station for drying the processed films and transport means for transporting said films through said processing stations and said drying station from a film loading point to a film discharge point, said processing stations including a rinsing station, said rinsing station comprising a rinsing tank having overflow means through which water can flow out of said rinsing station continuously, thereby maintaining a liquid level in said rinsing tank, means for continuously supplying fresh water to said rinsing tank during operation of said processor, said water supply means comprising conduit means extending up from the bottom of said rinsing tank and having a first opening near the bottom and a second opening above the liquid level in said tank, a fresh water supply line discharging into said conduit means above said second opening whereby bacterial, chemicals or contaminants are prevented from entering said supply line from said rinsing tank, and means for automatically controlling the supply of fresh water through said supply line.

11. An X-ray film processor according to claim 10, wherein said water supply controlling means comprises a solenoid valve in said water supply line, a contact arrangement above the normal water level in said rinsing station, said contact arrangement having two contacts, said contacts being arranged in such a manner that said two contacts are conductively connected one with the other by the conductivity of said water when the water level reaches said contacts, and circuit means including a relay to close said solenoid valve provided in the water supply line when said contacts are conductively connected one with the other, thereby interrupting the supply of water.

12. An X-ray film processor for processing cut films, comprising a plurality of processing stations for the wet development of X-ray films, said processing stations being arranged within a casing and being followed by a drying station for drying the processed films and transport means for transporting said film through said processing stations and said drying station from a film loading point to a film discharge point, said transport means comprising a plurality of roller sets removably disposed in said casing with each roller set in a respective processing station, each of said roller sets comprising spaced end panels, a plurality of rollers extending between said end panels and rotatably supported thereby, said rollers being disposed in position continuously to guide and transport said cut films through the respective processing station, a drive shaft rotatably supported by said end panels, gear means operably connecting said drive shaft with said rollers of the respective set to drive said rollers, a worm gear fixed on said drive shaft, a common worm shaft having worms meshing with said worm gears on the drive shafts of all of said roller sets when said roller sets are disposed in said casing, a single motor means for driving said common worm shaft and thereby driving said rollers of said roller sets, and means for positioning each of said roller sets in said casing with said worm gear on said drive shaft in mesh with the respective worm of said common worm shaft, said positioning means comprising an extension of said drive shaft extending beyond said worm gear, means in said casing rotatably to receive and position said drive shaft extension and latch means for releasably retaining said drive shaft extension in said receiving means, thereby retaining said roller set in said casing and retaining said worm gear in mesh with said worm, said processing stations comprising a developing station, a fixing station and a rinsing station, said drying station being located above said rinsing station, and said roller sets for said rinsing station and said drying station comprising separate drive shafts for each of said sets but common end panels rotatably supporting the rollers and the drive shafts of said sets, said roller sets being removable from said casing as a unit.

13. An X-ray film processor according to claim 12, wherein said roller sets for said developing station and said fixing station are alike and are interchangeable with one another.

14. An X-ray film processor according to claim 12, wherein said gear means of the roller set of said rinsing station includes planetary gear means.

* * * * *